US006273399B1

(12) United States Patent
Gatley

(10) Patent No.: US 6,273,399 B1
(45) Date of Patent: Aug. 14, 2001

(54) AIR PRESSURE STABILIZER

(76) Inventor: Richard Gatley, Lower Norgrove, Yarrington Lane, Alfrick, Worcestershire WR6 5EX (GB)

( * ) Notice: Subject to any disclaimer, the term of this patent is extended or adjusted under 35 U.S.C. 154(b) by 0 days.

(21) Appl. No.: 09/555,545

(22) PCT Filed: Dec. 15, 1998

(86) PCT No.: PCT/GB98/03748

§ 371 Date: Jun. 1, 2000

§ 102(e) Date: Jun. 1, 2000

(87) PCT Pub. No.: WO99/31442

PCT Pub. Date: Jun. 24, 1999

(30) Foreign Application Priority Data

Dec. 16, 1997 (GB) ..... 9726451

(51) Int. Cl.[7] ..... F16K 1/22
(52) U.S. Cl. ..... 251/308; 137/527.4
(58) Field of Search ..... 137/527.4; 251/308

(56) References Cited

U.S. PATENT DOCUMENTS 2,934,084 * 4/1960 Adams ..... 137/527.4
2,946,553 * 7/1960 Adam ..... 251/308 X
4,215,716 * 8/1980 Klenk et al. ..... 137/527.4
4,651,763 * 3/1987 Scobie et al. ..... 251/308 X
5,277,658 1/1994 Goettl .

FOREIGN PATENT DOCUMENTS 0 658 758 6/1995 (EP) .
2342446 9/1977 (FR) .

* cited by examiner

*Primary Examiner*—John Fox
(74) *Attorney, Agent, or Firm*—R. Neil Sudol; Henry D. Coleman; William J. Sapone

(57) ABSTRACT

An air pressure stabiliser device is adapted to be located in a aperture in a wall, which may be provided by ductwork, extending into and from a room within which the pressure is to be maintained in excess of atmospheric pressure, but which is vented when the pressure rises above a predetermined maximum. The stabilising device comprises two bearing assemblies defining a longitudinal axis, and a control member extending between the bearing assemblies, being supported thereby for rotation about said axis. Adjustment means are provided positionally to adjust the control member in a direction extending at right angles to the pivot axis, to adjust the excess pressure to which the control member responds and the threshold opening pressure. These adjustment means are provided to enable the control member to open fully in response to the detection of the desired excess pressure within the room being controlled.

11 Claims, 6 Drawing Sheets

AIR PRESSURE STABILIZER

BACKGROUND OF THE INVENTION

This invention is concerned with improvements relating to air pressure stabilizers.

Conventionally it is the practice in a surgically clean environment to maintain an environmental pressure slightly above atmospheric pressure, to prevent possibly contaminated air from flowing into the environment, such as through gaps in doors, windows and the like. Conventionally used to control this pressure is an air pressure stabilizing device comprising a duct defining an opening, and a control member mounted in the opening for movement between open and closed positions, the control member being operative to move from its closed position in the event that pressure in the area under control rises above a predetermined level above atmospheric pressure, and to return to its closed position in the event that pressure falls below said predetermined level.

In this way, pressure within the area under control may be retained at a desired positive pressure, above atmospheric pressure.

Conventionally, the opening lies in a generally vertical plane, in which context the invention will hereinafter be described, and a conventional air pressure stabilizing device comprises a control member in the form of a generally flat plate which is mounted for pivotal movement about a horizontal axis which extends below the geometric center line of the plate, but above the center of gravity of the plate. In this manner an upper part of the plate above said axis presents to the area being controlled an area greater than that presented by the lower part of the plate. The location of the pivot axis in relation to the center of gravity ensures that, at rest, the plate is retained in a closed position. However, as the pressure in the controlled area increases, the excess force on the plate above the pivot axis causes the plate to move from its closed position, to vent the excess pressure.

Alternatively, of course, the axis may extend above the geometric center line of the plate, and above the center of gravity of the plate.

In one commercially available device, the plate is provided with a counter-balance in the form of elongate tube secured to the lower edge of the plate, which may be filled with a quantity of lead shot, to provide a means for setting the device.

However, with such an arrangement the effect of the pressure on the control member reduces as the plate opens, whilst the effect of the counter-balance increases, thus producing a steady state condition in which the angle at which the control member is inclined is proportional to the excess pressure of the area being controlled, and this arrangement has the disadvantage that an increasing excess pressure has a reduced effect in opening the control member, and this may result in the production of high velocity exiting air, which is not desired.

To compensate for this effect, and to produce an air pressure stabilizing device a control member of which opens to a greater extent in the event of an excess of air pressure in the area under control, suggestions have been made to provide a cantilevered counter-balance, so constructed that the force acting on the control member to close the control member reduces as the control member is moved from the vertical position. The effect of using two such counter-balances is to produce a force which is substantially constant throughout the movement of the control member from its vertical position towards the horizontal position. In this manner when the pressure in the area being controlled exceeds the desired maximum, the control member will automatically move from its closed to its fully opened position, allowing excess pressure from the room to be vented without the production of excessive air flow. As the pressure within the area being controlled reduces, the force acting to move the control member from its closed position reduces to a level at which it is overcome by the counter-balancing means, and the control member is returned to its closed position.

Whilst in theory such devices should operate satisfactorily, difficulties are encountered in providing such devices, particularly in enabling them to be adjusted conveniently. For example, when the control member is fully balanced, a small rise in pressure in the controlled area may cause the control member to move rapidly to its fully opened position, which may cause too much venting, and too rapid a reduction in the pressure in the controlled area, with consequent return of the control member to its fully closed position, and it is one of the various objects of this invention to provide an air pressure stabilizing device which may be utilised to control the venting of excess air from an area being controlled more satisfactorily than has hereto for been found possible.

SUMMARY OF THE INVENTION

According to this invention there is provided an air pressure stabilizing device comprising a) a pivot mechanism adapted to be mounted across an opening and to provide a pivot axis extending across the opening;

b) means to enable a control member to be secured to the pivot mechanism thereby to be rotatable about the pivot axis for movement between a closed position in which it substantially closes the opening and an open position; and c) adjustment means positionally to adjust the control member "along a line" extending at right angles to the pivot axis.

Particularly, the adjustment means is operative positionally to adjust the control member as a whole along said line.

Preferably said line is straight, but may be curved, lying in a plane extending at right angles to the pivot axis.

In this manner the center of gravity of the control member may positionally be adjusted so as to produce desired movement of the control member, in the event of an excess pressure in the controlled area.

Preferably said direction is generally parallel to the plane in which the control member lies, that is parallel to the plane of the opening, whereby the control member may be moved relative to the pivot axis to adjust the offset of the center of gravity of the control member from the pivot axis.

In this manner the control member may conveniently be accurately positionally adjusted in the opening subsequent to being mounted therein, and in particular may be adjusted to provide a desired offset of the center of gravity from the pivot axis.

In this manner the extent to which the control member moves from its closed position, under a specific excess pressure, may be varied.

Alternatively said direction may be at right angles to the plane of the opening in which the control member lies.

In this manner, the threshold pressure required initially to rotate the control member about said axis may be increased, said force reducing as the control member moves about said axis from its closed to its open position.

Preferably however the adjustment means is operative positionally to adjust the control member in two directions extending at right angles to the pivot axis.

In this manner the control member may positionally be adjusted to adjust the balance of the control member, and to adjust the threshold pressure required to move the control member about said axis from its closed to its open position.

In particular, desirably said two directions are mutally perpendicular, and preferably one of said directions lies generally in the plane of the control member, the other of said directions lying generally at right angles to the plane of the control member.

In this manner adjustment in said first direction determines the offset of the center of gravity below the pivot axis, and therefore the pressure sensitivity band (that is the magnitude of the pressure increase required to cause the control member to move fully from its closed to its open position), whilst movement in the second direction determines the threshold opening pressure.

Alternatively, said directions may lie in mutually inclined planes, whereby movement of the control member firstly in a direction generally in the plane of the control member may be accomplished, and secondly in a direction generally at right angles to the plane of the control member may be accomplished, by a combination of vector movements.

Preferably, the device comprises a bearing, providing the axis about which in use the control member rotates, and a support member or housing carried by the bearing, to which housing the control member is secured, the adjustment means being operative positionally to adjust the housing relative to the bearing.

Preferably, the adjustment means comprises screw threaded adjustment means, operative positionally to adjust the housing relative to the bearing, and preferably where two bearings are provided on opposite sides of the opening, a screw threaded adjustment member is provided on each side of the opening.

BRIEF DESCRIPTION OF THE DRAWINGS

There will now be given a detailed description, to be read with reference to the accompanying drawings, of two air pressure stabilizing devices which are preferred embodiments of this invention, having been selected for purposes of illustrating the invention by way of example.

In the accompanying drawings.

DESCRIPTION OF THE PREFERRED EMBODIMENTS

Figure 1:
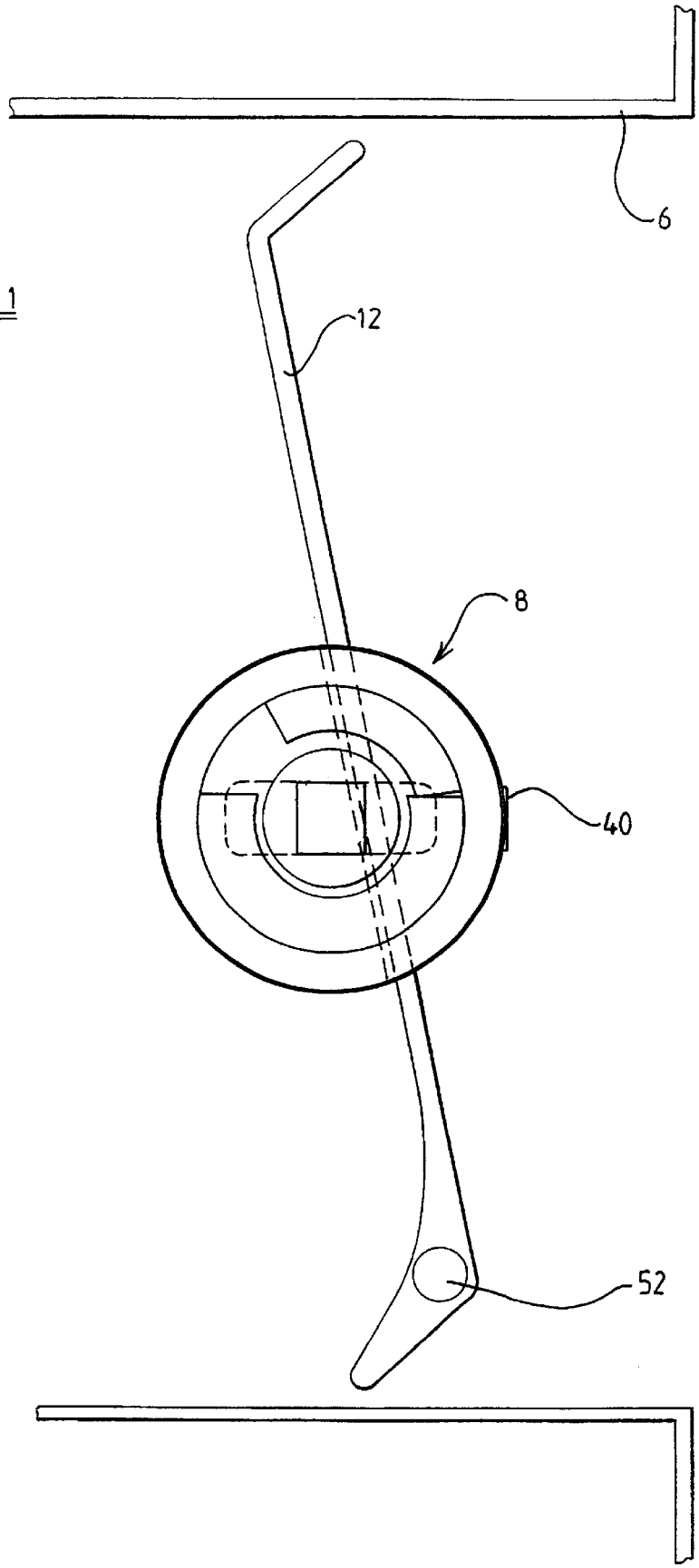
FIG. 1 is a side elevational view, showing a first air pressure stabilizing device mounted in an opening in an environment to be controlled.

The control device which is the first embodiment of this invention is adapted to be located in an aperture 6 in a wall, which may be conveniently provided by ductwork, extending into and from a room within which the pressure is to be maintained in excess of atmospheric pressure, the stabilizing device comprising two bearing assemblies 8, only one of which is shown, defining a longitudinal axis 10, and a control member 12 extending between the bearing assemblies 8, being supported thereby for rotation about said axis 10.

Each bearing assembly comprises a bearing member 14 and a bearing shaft 18 extending into and supported by the bearing member 14, the shaft 18 supporting at an end portion thereof a disc member 20. The bearing member is secured in position within the housing by a yoke 22. The yoke is part-annular in form, subtending an angle of a little more than 180°, and is secured to the duct defining the opening in which the subject device is mounted. In use, the bearing member is mounted on the yoke 22 by pressing the bearing member 14 into the semi-circular recess, momentarily deforming the extremities of the yoke, as the bearing snaps into position within the yoke.

Carried by the disc member 20 on the side thereof remote from the shaft 18 is an axial spindle 24 of rectangular cross-section diametrically through which a threaded bore 25 extends, and mounted over the spindle 24 is a generally cylindrical support member 30, which is provided with a diametral slot 32 into which the spindle 24 extends. Captively located on the support member is an adjustment member in the form of a screw 40, said screw extending generally diametrically of the support member 30 and passing through the threaded bore 25 of the spindle 24. As will be appreciated, by rotation of the adjustment screw 40, the support member may be positionally adjusted on the spindle 24 in a direction extending at right angles to the longitudinal axis 10, specifically when the control device is assembled in position, in the horizontal direction. Thus, by movement of the center of gravity of the whole of the control member, appropriate adjustment may be made to the control device relatively simply, and that adjustment is appropriate irrespective of the axial extent of the control member.

Figure 2:
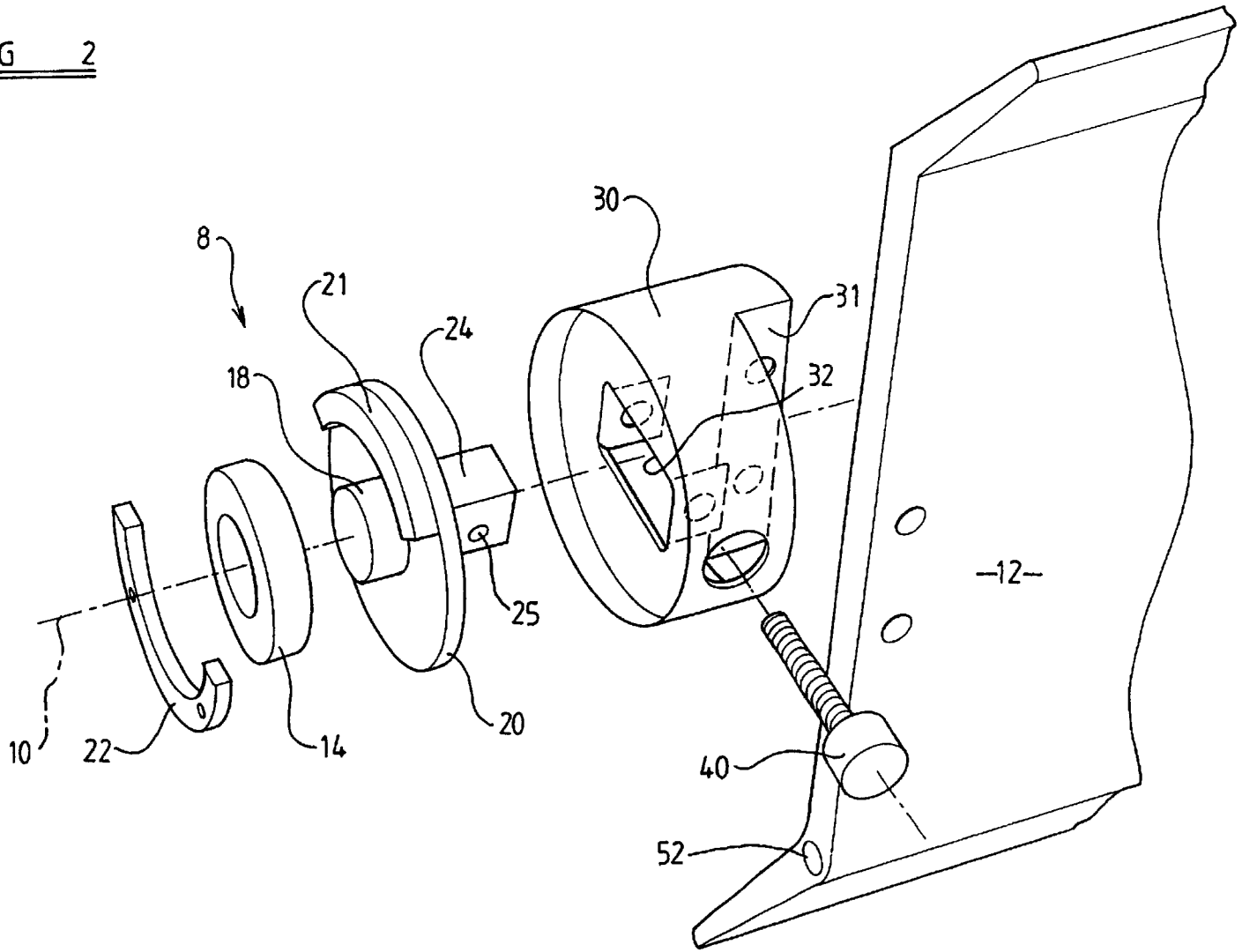
FIG. 2 is an exploded perspective view showing bearing mechanism of the device.
Figure 3:
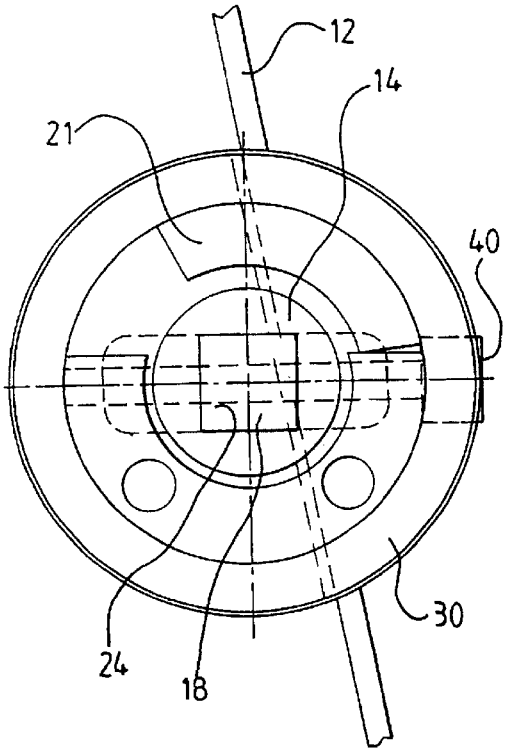
FIGS. 3, 4 and 5 are end elevations, showing different positions adopted in use.

As is shown in FIG. 2, the control member 12 is secured to a flat diametral face 31 of the support member 30 extending generally at right angles to the axis of the slot 32, such that as the support member rotates, so does the control member 12.

Figure 5:
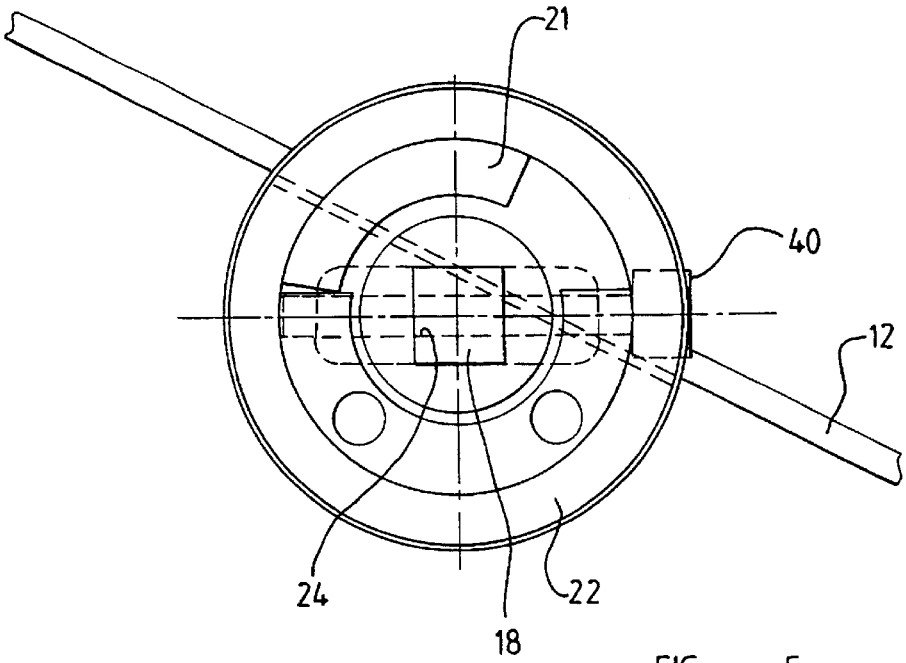

When the control device is mounted in position in relation to a control opening 6, such as generally to fill the opening, the axis 10 about which the control member rotates is below the geometrical center C/L of the opening, the control member being provided with a counter-balance 52 to urge the control member into the closed position shown in FIG. 1. When the pressure P within the room being controlled exceeds a predetermined threshold, the differential pressure on the upper part of the control member above the axis 10 will cause the control member to move in an anti-clockwise direction, to open the control member to allow venting of the atmosphere, the degree of opening being determined in part by engagement of an arcuate stop 21 with the yoke 22 (see FIG. 5).

Figure 6:
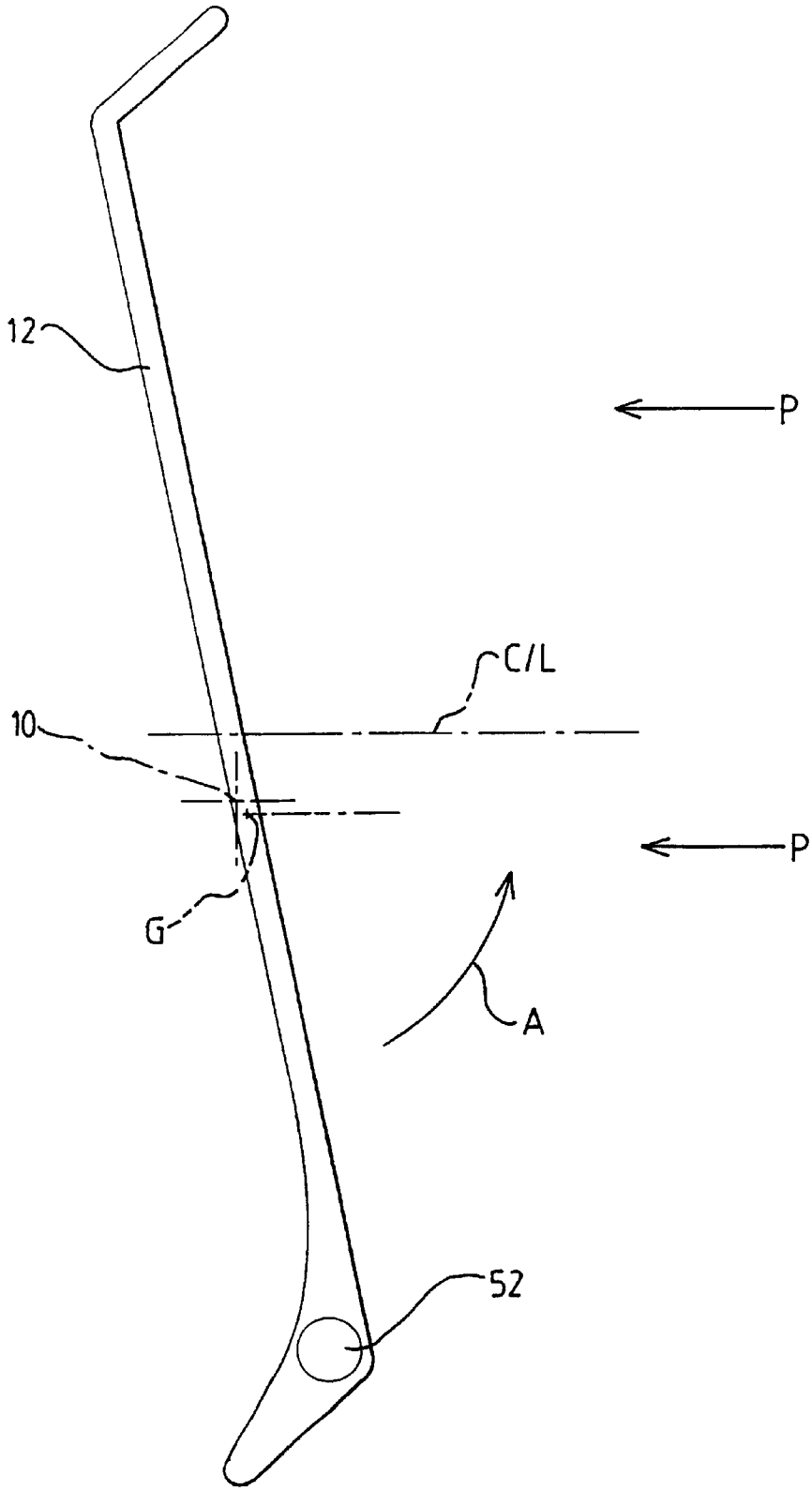
FIG. 6 is a schematic view showing the movement of various axes during adjustment of the device.

However as is shown in FIG. 6, the center of gravity G of the control member is located a small distance to the right of the axis 10, and thus movement of the control member in its opening direction (shown by the arrow A) also involves lifting of the center of gravity G. Since the forces acting on the control member by virtue of the counter-balance 52, and by location of the center of gravity in relation to the axis 10 are substantially at right angles to one another, in effect this allows the control member, when conditions are balanced, readily to move through 45° into engagement with the stop, to permit excess pressure to be vented easily.

Figure 4:
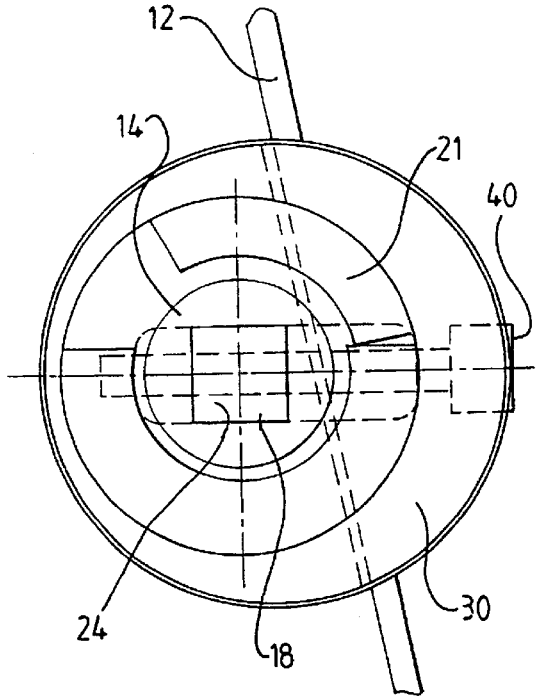

On assembly of the control device, the precise location of the center of gravity of the support member 30 and control member 12 may be adjusted as is shown in FIG. 4 by rotation of the adjustment screws 40 associated with the two bearings of the device, to ensure that the separation of the center of gravity from the axis 10 is precisely as required.

In particular it is envisaged that movement of the support member by ±1–2 mm will enable the control device to be set up to operate effectively and efficiently.

Figure 7:
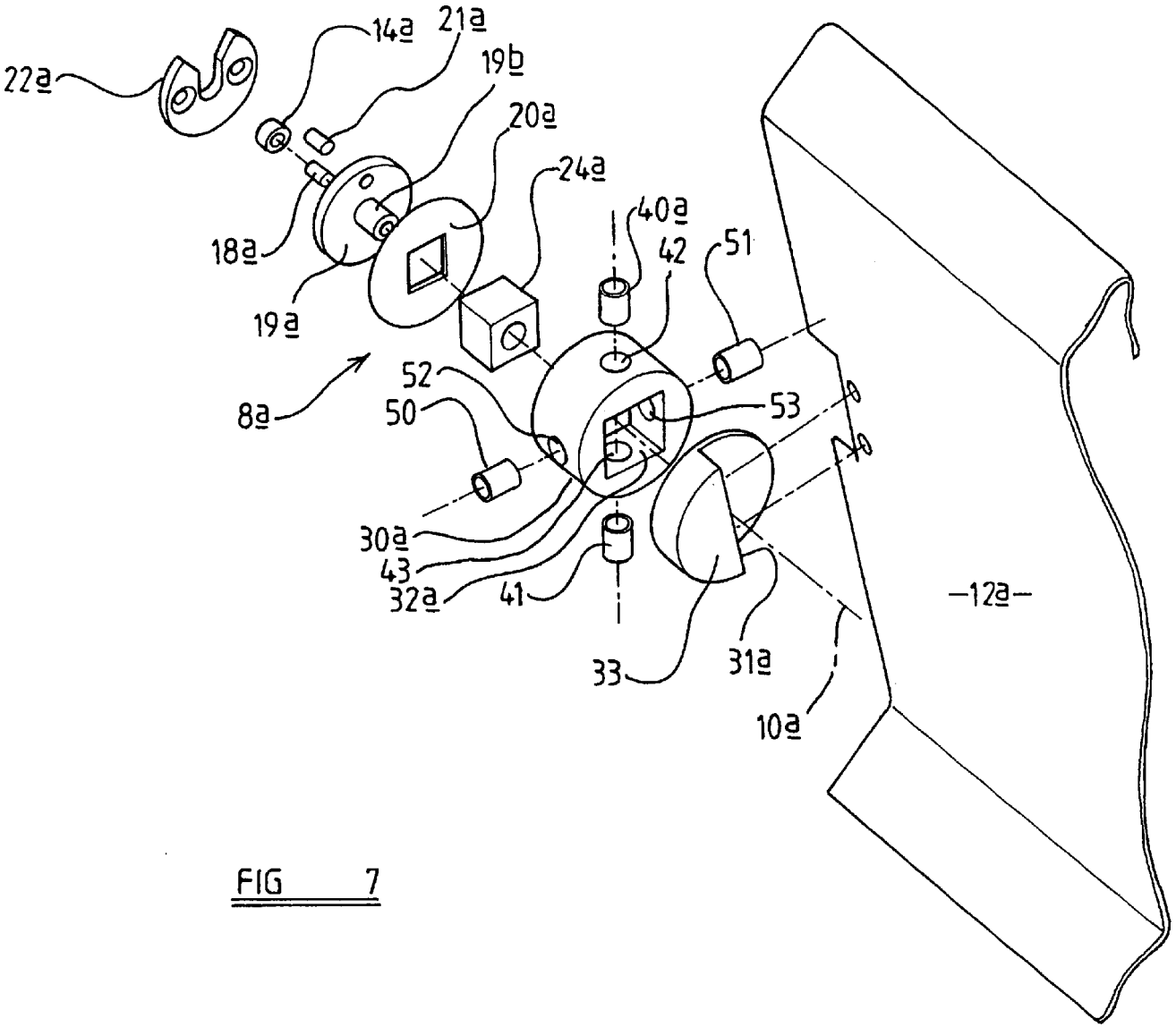
FIG. 7 is an exploded perspective view of a second air pressure stabilizing device.

The device which is the second embodiment of this invention is somewhat similar to the first, but comprises adjustment means to positionally adjust the control member in two mutually perpendicular directions, particularly one direction being in the plane of the control member, the other being in a direction at right angles thereto. As will be seen from the drawings, in FIG. 7 similar numerals with the suffix a have been used to indicate parts which are similar to the first embodiment, and the second embodiment will be described hereinafter primarily insofar as it differs from the first embodiment.

Thus, the stabilizing device which is the second embodiment of this invention comprises two bearing assemblies 8*a*, only one of which is shown, defining a longitudinal axis 10*a*, and a control member 12*a* extending between the bearing assemblies, being supported thereby for rotation about said axis 10*a*.

Each bearing assembly comprises a bearing member 14*a*, and a bearing shaft 18*a* extending into and supported by the bearing member 14*a*, the shaft 18*a* supporting at an end portion thereof a disc member 19*a* carrying an axial boss 19*b*. The bearing member 14*a* is secured in position within the housing by a yoke 22*a*, the yoke comprising a central semi-circular recess into which the bearing member 14*a* may be pressed. A stop 21*e* may be utilised, to limit rotational movement of the disc member 20*a*.

The adjustment means comprises a generally cylindrical support member 30*a*, which is provided with a central rectangular aperture 32*a*, in which aperture an axial spindle 24*a* of rectangular cross-section is located. The spindle 24*a* is retained in the aperture 32*a* by a rear plate 20*a*, and a support member 33.

The boss 19*b* passes through the plate 20*a* and into an axial bore in the spindle 24*a*. The boss 19*b* is a sliding fit within said bore, and the spindle 24*a* is located within the aperture 32*a* with limited freedom of movement in mutually perpendicular axes, to the extent of, typically, plus or minus 3mm in each direction.

The support member 33 is provided with a diametral face 31*a*. to which the control member 12*a* is secured.

In the second embodiment the support member 30*a* is provided with two sets of adjustment members 40, 41; 50, 51. The adjustment members 40 and 41 are in the form of grub screws which are located in twin bores 42, 43 located in the support member and lying on a diametral line which passes through the axis 10*a*, and which in use lies in the vertical plane, whilst the adjustment members 50, 51 are provided by grub screws which lie in twin bores 52, 53 located in the support member and lying on a diametral line which passes through the axis 10*a* and which in use lies in the horizontal plane. Thus, by operating on the two adjustment members of each set, the support member 30*a* may be moved relative to the spindle 24*a*, defining the longitudinal axis 10*a*, either in the horizontal plane or in the vertical plane.

Thus, by adjustment of the members 40, 41, the control member may be moved vertically within the opening, to vary the position of the center of gravity of the control member beneath the axis 10*a*.

In this manner, the extent to which the control member opens when the pressure in the room rises above the threshold may be set.

As will be appreciated by those skilled in the art, as the control member is rotated about its axis, and the center of gravity is moved from a position beneath the axis, the effect of the center of gravity in resisting further movement of the control member increases, resulting in general in an increase in the force required to cause further opening movement of the control member. In general this is seen as a partial opening movement only of the control member in response to a specific increase in pressure, higher pressure being required to cause further movement of the control member in the opening direction.

However, by movement of the center of gravity to one side of a vertical line passing downwardly through the pivot axis compensates for this.

Thus, with the control member in its vertical position, the effect of the center of gravity being to one side of said line reduces as the control member from its closed towards its open position.

In this manner, by appropriate adjustment of the position of the control member in both directions, a balance may be obtained which results in a full movement of the control member from its closed to its open position in response to excess pressure in the room being controlled.

Figure 8:
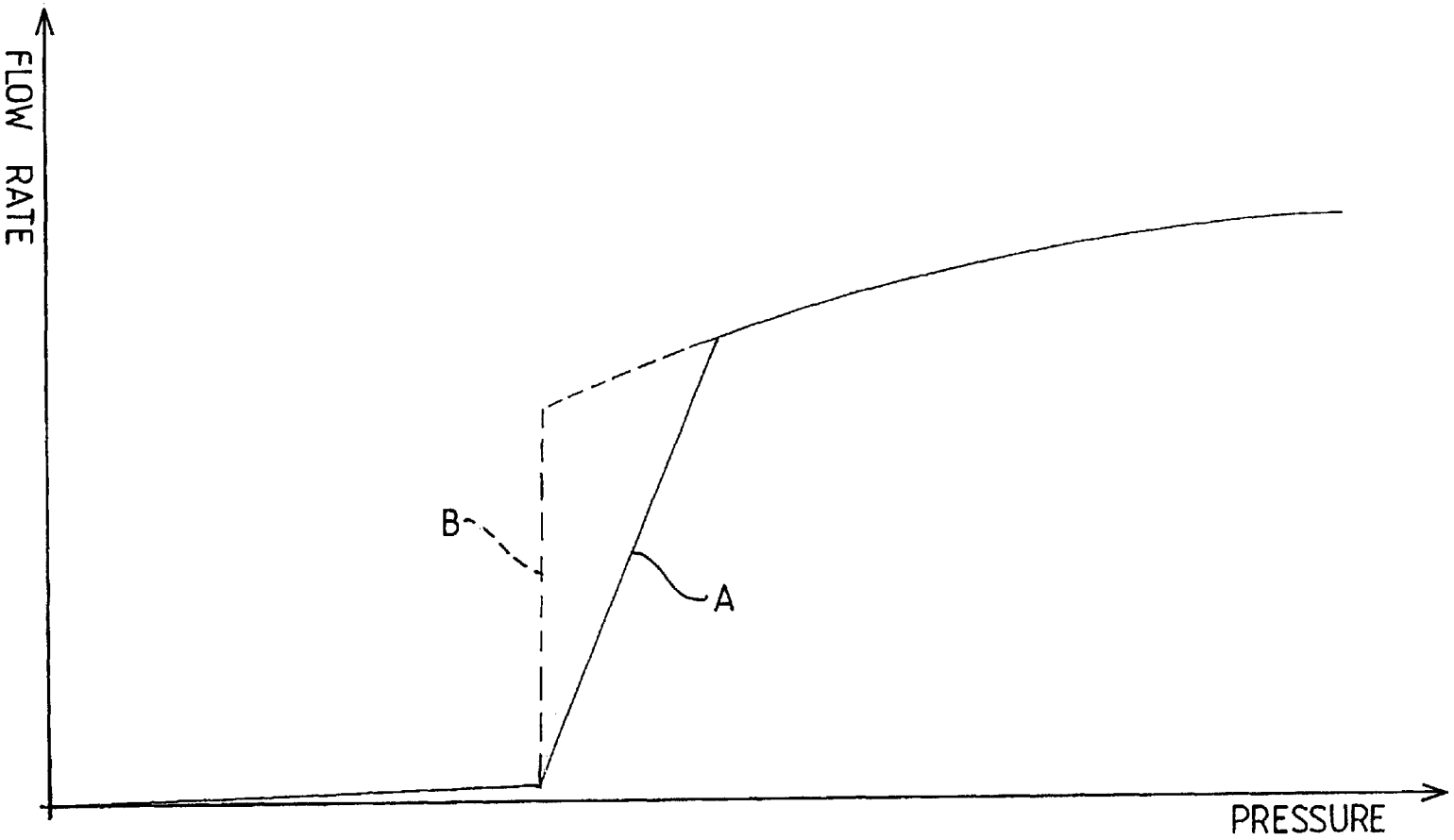
FIG. 8 is a graph showing response of the preferred embodiments to increasing air pressure.

FIG. 8 shows, at line A, the response of a conventional air pressure stabiliser to increasing pressure in the environment being controlled. It will be appreciated that the increase in pressure needed to cause the control member to fully open (the pressure sensitivity band) is large. Conversely, line B shows the response of the air pressure stabilizing device which is the second embodiment of this invention. As can been seen the pressure sensitivity band is narrow, producing a rapid, but not uncontrolled, response of the flow control member to pressure increasing above the threshold.

It is to be appreciated, that whilst the invention has been described above for use in an opening located in the vertical plane, the preferred embodiments may be utilised to advantage in the control of air flowing through an opening which lies in other orientations, eg. horizontally. In such circumstances, modifications may be necessary, which will be within the competence of the man skilled in the art. For example, in the first embodiment, it may be desirable to utilise a support member 30, the slot 32 of which extends at right angles to that shown in FIG. 2, to enable, by adjustment of the screw 40, a similar bodily movement of the flow control member 12 in the horizontal direction.

As far as the second embodiment is concerned, mounting of the air pressure stabilizing device in a horizontal opening will simply produce a substitution of the effects of the two sets of control elements 40*a*, 41; 50, 51.

Additionally, since the invention the subject of this application produces its desired effect by bodily movement of the flow control member as a whole in relation to the axis about which it is mounted for rotation, appropriate adjustment may be made in the second embodiment. irrespective of the orientation of the opening to the horizontal. In particular, the air pressure stabilizing device may be mounted in an opening which extends at 450 to the horizontal, and appropriate adjustment may be made to the position of the flow control member, by appropriate adjustment of the elements 40*a*, 41; 50, 51.

Whilst the invention has been described above in relation to the venting of air from an environment which is maintained at a pressure slightly in excess of atmospheric pressure, it is to be appreciated that the invention may be used in similar circumstances, where it is a differential air pressure which is being maintained, whether or not the pressure is in excess of atmospheric pressure.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. An air pressure stabilizing device comprising:

a pivot mechanism providing a pivot axis and incorporating mounting means for securing the pivot mechanism to opposed walls defining an opening, the pivot axis extending across the opening;

securing means for securing a control member to the pivot mechanism thereby to be rotatable about the pivot axis for movement between a closed position in which the control member substantially closes the opening and an open position; and adjustment means between the control member and the pivot mechanism which is operative positionally to adjust the control member in a direction extending at right angles to the pivot axis.

2. The device according to claim 1 wherein the said direction is generally parallel to a plane in which the control member lies.

3. The device according to claim 1 wherein said direction is at right angles to the plane in which the control member lies.

4. The device according to claim 1 wherein the adjustment means is operative positionally to adjust the control member in two directions extending at right angles to the pivot axis.

5. The device according to claim 4 wherein said two directions are mutually perpendicular.

6. The device according to claim 5 wherein one of said directions lies generally in a plane of the control member, the other of said directions lying generally at right angles to the plane of the control member.

7. The device according to claim 6 wherein said directions lie in planes whereby movement of the control member firstly in a direction generally parallel to the plane of the control member may be accomplished, and secondly in a direction generally at right angles to the plane of the control member may be accomplished.

8. The device according to preceding claim 1 wherein the pivot mechanism comprises a bearing which provides the axis about which in use the control member rotates, and the securing means comprises a support member carried by the bearing to which support member the control member is secured, the adjustment means being operative positionally to adjust the support member relative to the bearing.

9. The device according to claim 8 wherein the adjustment means comprises screw threaded adjustment means, operative positionally to adjust the support member relative to the bearing.

10. The device according to claim 9 wherein the adjustment means is operative positionally to adjust the housing in two mutually perpendicular directions.

11. The device according to claim 1, comprising two bearings on opposite sides of the opening, screw threaded adjustment means being provided on each side of the opening.

* * * * *